US010340061B2

(12) United States Patent
Koeppendoerfer

(10) Patent No.: US 10,340,061 B2
(45) Date of Patent: Jul. 2, 2019

(54) DATA LINE AS WELL AS METHODS FOR PRODUCING THE DATA LINE

(71) Applicant: LEONI Kabel Holding GmbH, Nuremberg (DE)

(72) Inventor: Erwin Koeppendoerfer, Schwabach (DE)

(73) Assignee: LEONI Kabel Holding GmbH, Nuremberg (DE)

( * ) Notice: Subject to any disclaimer, the term of this patent is extended or adjusted under 35 U.S.C. 154(b) by 0 days.

(21) Appl. No.: 15/163,887

(22) Filed: May 25, 2016

(65) Prior Publication Data

US 2016/0268021 A1 Sep. 15, 2016

Related U.S. Application Data

(63) Continuation of application No. PCT/EP2014/075335, filed on Nov. 21, 2014.

(30) Foreign Application Priority Data

Nov. 25, 2013 (DE) ..... 10 2013 224 044
Apr. 11, 2014 (DE) ..... 10 2014 207 010

(51) Int. Cl.
*H01B 11/06* (2006.01)
*H01B 11/18* (2006.01)
(Continued)

(52) U.S. Cl.
CPC ..... *H01B 11/1895* (2013.01); *H01B 11/1826* (2013.01); *H01B 13/14* (2013.01); *H01B 13/22* (2013.01); *H01B 13/2693* (2013.01)

(58) Field of Classification Search
CPC ..... H01B 11/06; H01B 11/08
(Continued)

(56) References Cited

U.S. PATENT DOCUMENTS 3,634,606 A * 1/1972 Iyengar ..... G02B 6/4435 174/102 D
3,662,090 A * 5/1972 Grey ..... H01B 11/1808 156/54

(Continued)

FOREIGN PATENT DOCUMENTS

DE 2020585 * 11/1971
DE 10 2008 019 968 A1 10/2009

(Continued)

*Primary Examiner* — Chau N Nguyen
(74) *Attorney, Agent, or Firm* — Muncy, Geissler, Olds & Lowe, P.C.

(57) ABSTRACT

A data line that is designed as a coaxial cable and has a line core that extends in a line longitudinal direction. The line core has at least one conductor surrounded at least by insulation and is surrounded by a multi-layer shielding foil, which has a non-conductive layer and a conductive layer. In an overlap region, a free end edge overlaps a further partial region, wherein additionally a conductive connection of the conductive layer at the end edge to the further partial region is formed such that a transverse current flow perpendicular to the longitudinal direction within the conductive layer is enabled. The conductive connection is formed optionally as a conductive strip and/or by a beveled end edge. In particular, the data line is a data line shielded exclusively via the shielding foil. The data line is used in particular in a motor-vehicle electrical system.

13 Claims, 2 Drawing Sheets

(51) Int. Cl.
*H01B 13/26* (2006.01)
*H01B 13/14* (2006.01)
*H01B 13/22* (2006.01)

(58) Field of Classification Search
USPC ..... 174/36
See application file for complete search history.

(56) References Cited

U.S. PATENT DOCUMENTS

| | | | | |
|---|---|---|---|---|
| 3,927,247 | A | 12/1975 | Timmons | |
| 4,577,054 | A * | 3/1986 | deRonde | H01R 9/05 174/361 |
| 4,691,081 | A * | 9/1987 | Gupta | H01B 11/1826 174/105 R |
| 5,368,935 | A * | 11/1994 | Inazawa | C08G 77/60 174/110 S |
| 6,596,393 | B1 * | 7/2003 | Houston | C23F 11/149 174/109 |
| 7,084,343 | B1 | 8/2006 | Visser | |
| 7,601,915 | B2 * | 10/2009 | Lumachi | H01B 3/30 156/54 |
| 2008/0308674 | A1 * | 12/2008 | Frantz | F24F 13/0263 244/118.5 |
| 2009/0260847 | A1 | 10/2009 | Tobben et al. | |

FOREIGN PATENT DOCUMENTS

| | | |
|---|---|---|
| EP | 0 301 859 A2 | 2/1989 |
| GB | 1 168 479 A | 10/1969 |

* cited by examiner

DATA LINE AS WELL AS METHODS FOR PRODUCING THE DATA LINE

This nonprovisional application is a continuation of International Application No. PCT/EP2014/075335, which was filed on Nov. 21, 2014, and which claims priority to German Patent Application No. 10 2013 224 044.9, which was filed in Germany on Nov. 25, 2013, and to German Patent Application No. 10 2014 207 010.4, which was filed in Germany on Apr. 11, 2014, and which are both herein incorporated by reference.

BACKGROUND OF THE INVENTION

Field of the Invention

The invention relates to a data line, in particular for use in a motor vehicle, and a method for producing such a data line.

Description of the Background Art

A data line may be formed as a coaxial cable is, for example, set out in U.S. Pat. No. 7,084,343 B1. The coaxial cable described therein comprises a central inner conductor, an insulation surrounding this as a dielectric, a multi-layered shielding as an outer conductor and an outer shell. The multi-layer shielding is thereby formed from a longitudinally folded shielding foil and a braided shield mounted above. With this structure, the coaxial cable is relatively stiff. As an alternative to the multi-layered shielding, this is designed in the form of a corrugated tube, as is known in so-called semi-rigid cables.

Due to the high rigidity, such a cable is of limited use in regions with alternating bending stresses. Also, because of the rigidity, its use in motor vehicles is often not practical.

Such a cable is also less suitable for use in the automotive industry for cost reasons, in particular because of the multi-layered shielding construction. In particular, the formation of the shielding constitutes one of the biggest cost and time factors. The shielding technically serves to keep radiation interference from the signals included inside the coaxial line and also to focus and guide a propagating field. For this purpose, the shielding is usually made of a braid, more rarely of a spiral shielding or a foil shielding. In a number of lines there are also combinations of different screen constructions. Braided shielding allows for only slow speeds to be realized during the manufacturing process, which results in a very large machine park of braiding machines, which inherently require a lot of staff, space and energy.

The semi-rigid cables are coaxial lines, wherein the outer conductors is formed of a closed tube. These cables have excellent electrical properties, however, are difficult to manufacture, expensive and almost inflexible.

Another coaxial cable is set out in U.S. Pat. No. 3,927,247. The shielding here is formed from a longitudinally folded shielding foil, which is in turn helically surrounded by ground wires. The shielding foil itself is designed of two or three layers with a plastic carrier film and a metal layer applied thereto. This shield structure is also relatively expensive to manufacture.

In addition to the coaxial lines, high-speed data lines are known in which normally one conductor pair is surrounded by a pair shielding. In these high-speed data lines, multi-layered shielding foils are also habitually used for shielding. An example of such a data transmission cable with a wire pair surrounded by a pair shielding can be seen in DE 10 2008 019 968 A1. Here, the shielding foil is also folded longitudinally, wherein the one end of the film is additionally folded in an overlap region, so that a conductive layer is oriented to the outside towards a drain wire or ground wire, so that an electrical connection is formed to the grounding wire. Such high-speed data cables are used for very high transmission frequencies up into the gigahertz range. However, they are relatively expensive to manufacture.

SUMMARY OF THE INVENTION

It is therefore an object of the present invention is to provide a low-cost manufactured, shielded data line with good shielding effect and a method for its production.

In an exemplary embodiment, the data line includes a line core extending in a longitudinal direction which comprises at least one conductor surrounded by an insulation and which is surrounded by a multi-layered shielding foil. Lastly, the shielding foil is surrounded by an outer shell. In the preferred embodiment, directly without further intermediate layers. The shielding foil has a non-conductive layer and a conductive layer, wherein in an overlap region, a free end edge of the shielding foil overlaps a further partial region of the shielding foil. In the overlap region, an electrically conductive connection of the conductive layer on the end edge is now formed with the conductive layer in the partial region. The conductive layer is therefore connected by the ends of the end edge with the further partial region of the conductive layer. In this way, in spite of the non-conductive layer, a completely circumferential conductive connection is formed within the conductive layer, so that a transverse current flow is provided perpendicular to the longitudinal direction.

Due to the multi-layer design of the shielding foil, a sequence of layers between the conductive layer and the non-conductive layer is present in conventional foils in the overlap region. This has the possible effect of an interfering, high-frequency radiation being incident between the conductive layers, through the non-conductive layer of the shielding foil. As compared to a normal overlapping shielding foil, the configuration with the conductive connection of the free end edge with the other flat partial region improves the shielding of the cable.

Conveniently, the shielding foil in the overlap region is not folded, i.e., in the overlap area, the ends of the shielding foil lie flat and fold-free on one another. Therefore, no bending or folding of the shielding foil (by about 180°) is required in the edge region, which would typically be complicated to manufacture and thus expensive to implement.

In view of a possibly low-cost and simple configuration, a further shielding element is also omitted. It is therefore a purely foil-shielded data line in which a multi-layered shielding foil is provided as the only shielding element.

This multi-layered shielding foil is a conventional shielding foil with a plastic carrier layer as non-conductive layer, in particular a PET carrier layer. An electrically conductive coating is applied thereto at least on one side. Suitable materials are electrically conductive metals and optionally also electrically conductive carbon compounds. Preferably, a copper layer is used as conductive layer. Depending on the application, the surface of the copper layer is tailored to the desired application conditions of the data line to be additionally functional, with additional layers such as tin, silver or nickel.

A three-layered shielding foil can be used having an average carrier layer as non-conductive layer, to both sides of which in each case a metallic coating is applied. Alternatively, a solely two-layer shielding foil with a non-conductive layer and a conductive layer can be used. The individual layers are thereby attached to each other in each case over the entire surface, in particular by means of a laminating process. Therefore, the conductive layer covers the non-conductive layer over the entire surface and completely.

In an embodiment, a shorting bar can be formed between the end edge and the further partial region. This is in particular formed by a conductive strip mounted in the end edge region. This is formed conveniently by applying a conductive material by means of a suitable application method such as spraying, printing or brushing. Alternatively, the conductive strip can also be adhesively bonded.

In such data lines, the outer shell is applied in an extrusion process by means of a (shell) extruder. For the application of the conductive strip, this extrusion process is now modified such that immediately prior to applying the outer shell, the conductive strip is applied by means of the shell extruder. In terms of process engineering, this can be achieved using the application methods mentioned without sacrificing processing speed. In particular, in this case, a conductive fluid is applied. This has a sufficiently high viscosity so that it does not drain. Additionally, or alternatively, it has appropriate quick-drying properties. The conductive material applied is, for example, a conductive ink, conductive silver or a conductive adhesive. As application methods, such methods are thereby used which enable a continuous application, in particular in the context of a continuous extrusion process. For this purpose, for example, so-called printing wheels are used, the so-called tampon printing process, or also spray and dispenser methods. The conductive strip is applied in the overlap region, directly during extrusion in front of an extrusion head with which the outer shell is applied. The desired shorting bar is formed by the conductive strip from the end edge to the further, flat partial region of the conductive layer.

Alternatively, or in addition to the application of a conductive strip, for forming the electrically conductive connection in the overlap region, the shielding foil itself is modified in such a way that at the end edge, the conductive layer extends beyond the non-conductive layer. In this way, direct contact and therefore electrical contact between the protruding partial region of the conductive layer and the further partial region of the same conductive layer is achieved.

To make this possible in a particularly inexpensive and simple way to manufacture, the shielding foil can thereby be beveled at an angle at the end edge. In terms of production, a common, conventionally produced foil therefore only needs to be beveled on an edge region. To this end, the beveled end edge is formed, for example, by a cutting tool, in particular a knife, when cutting the foil. The knife is therefore positioned obliquely at the desired angle with respect to the foil. This angle is—relative to a surface normal of the foil—preferably more than 30° and in particular more than 45°. Conveniently, the angle here is at least 60° so that at this angle, the free end edge is oriented with respect to one of the surface normals of the shielding foil. Overall, a comparatively flat extending end edge, i.e., a large angle, guarantees that on the end face, the conductive layer is contacted with itself. In the overlap region, therefore, the further partial region quasi conforms "flat" against the beveled end edge.

As an alternative to cutting the foil to form the desired bevel, the bevel can be obtained by grinding or scraping initially perpendicular cutting edges. With such beveled end geometries, improvements in the shielding effectiveness can be expected, which lie within the range of about 5 dB.

This method with the front foil beveled on the end edge can basically be used in all shielded types, i.e., both for banded shielding foils, which are wound helically around the line core, as well as for longitudinally applied shielding foils, in which the overlap region extends parallel to the longitudinal direction.

Conveniently, the shielding foil, however, is formed as a longitudinally-folded foil, in which the end edge extends parallel to the longitudinal direction. The embodiment is preferable for production with regard to high process speeds because due to the winding process, a slowing down of the manufacturing process takes place in coiled shielding foils, which adversely affects production costs. Overall, therefore, with the longitudinally folded shielding foil and the simultaneous absence of further shielding layers, in particular braided shields, in addition to the electrically conductive connection at the end edge, the advantages of shielding designed like a tube in a semi-rigid cable are combined with those of a braided shield associated with low production costs. Because of the longitudinally applied foil, a closed surface results that is comparable to that of a semi-rigid cable. At the same time, a high degree of flexibility is ensured by using a shielding foil, which makes the data line suitable for use with reverse bending stresses or for those applications where high bending flexibility is desired.

In order to ensure this high level of flexibility, in this case the conductive layer of the shielding foil has an overall thickness of preferably less than 50 microns, and especially in the range of 3 microns to 35 microns. Preferably, it has a thickness in the range of 20-30 microns. Generally, also thicker conductive layers can be used, for example, up to 100 microns or 200 microns. However, this progressively leads to undesirable stiffening. The thicknesses of the individual layers of the shielding foil are usually comparable, whereas often the thickness of the non-conductive plastic carrier layer is greater than the conductive layer applied by a metal layer. The thickness of this metal layer is as mentioned preferably in the range between 20-30 microns. In a two-layer shielding foil with only one conductive layer, the total thickness of the shielding foil is then preferably at about 40 microns to 80 microns and in a three-layered shielding foil with two conductive layers, at about 50 to 100 microns.

Particularly in flexurally flexible cables, folding of the shielding foil in a bend is to be avoided to obtain a shielding as reliable as possible. To achieve this, the shielding foil in the preferred embodiment is surface-bonded with the insulation, so that the insulation is circumferentially completely connected to the shielding foil. For this purpose, in particular an adhesive layer is formed, which is designed as an adhesive layer and particularly as a hot-melt adhesive layer. According to a first embodiment, this adhesive layer is applied to the shielding foil. In an alternative embodiment, the adhesive layer is applied to the insulation outside. To enable this full-surface bonding in terms of manufacturing technology, the adhesive layer is applied in the manufacturing process preferably just immediately before mounting the shielding foil. For this purpose, in particular a heat-activatable hot-melt adhesive layer is applied. The particular advantage is that it is activated only by the heat introduced during the subsequent shell extrusion, i.e., the shielding foil is adhesively bonded to the insulation. When using such a hot-melt adhesive layer, the bonding is therefore carried out directly during the extrusion process. After cooling, the shielding foil is reliably fixed in the desired position. Using this measure, the continuous production process is not disturbed and folds can also be reliably avoided when bending the data line, which would interfere with RF signals.

Another advantage is the fact that particularly the overlap region where the individual partial regions of the foil bear against one another, are fixed to each other.

In such a purely foil shielded data line, the electrical contact of the shielding foil with a contact element, for example for the termination of a connector, is not readily possible due to the low rigidity of the shielding foil. Conventional contacting operations such as crimping cannot be used. In a suitable embodiment, therefore, the shielding foil is cohesively electrically connected to a contact element at the ends of the data line, in particular by gluing or soldering. The contact element is thereby formed according to a first embodiment as a contact sleeve, into which the end of the data line of the shielding foil is inserted. Subsequently, the adhesive or solder bonding takes place, which is in turn appropriately heat-activated.

According to an embodiment, a conventional crimp contact element is used, which usually has a cage or a receiving portion with crimping lugs. In this receiving area, the data line is inserted on the end side and then the shielding foil is connected in an electrically conductive manner in this crimping area in particular by soldering.

To form the solder or adhesive connection, in the manufacturing process the conductive adhesive or solder are conveniently applied outside the shielding foil in particular in the shape of a ring at one end of the data line, before the data line is then inserted into the contact element and contacted with this electrically.

To form the solder joint, the contact element is temporarily locally heated, so that the applied solder paste is caused to melt and thereby provides a permanent soldered connection between the shielding foil and the contact element. The short-term heating is preferably carried out electrically by a high current briefly imposed via contacts. In this way, a spatially and temporally defined input of heat can be provided in a simple manner. That is, two electrical electrodes for electrical resistance heating are brought to the contact element in the area of the contacting/soldering zone.

In order to avoid damage of the insulation during the soldering process, it conveniently includes heat-resistant material which for the duration of the soldering process at least temporarily withstands a temperature of over 100° C. and preferably over 150° C. This means that the insulation is not damaged by the inflow of heat. In view of the desired heat-resistant design, the insulation has in particular of a cross-linked plastic. Massive or also foamed insulation can thereby be used as insulation.

The data line can be formed as a coaxial cable, wherein the shielding foil forms an outer conductor. The data line is therefore formed from the one central conductor, which is surrounded by the insulation acting as a dielectric, which in turn is directly surrounded by the particularly full-surface glued shielding foil as the only shield element. Lastly, around this, the outer shell is directly applied.

Alternatively, the line core comprises a plurality of conductors, each surrounded by a (core) insulation, i.e., it is particularly designed to be multi-core. The entire multi-core line core is then surrounded by the one, common shielding foil. The individual cores thereby each have a conductor and a core insulation surrounding said conductor. The shielding foil thereby surrounds the composite of the cores, which if necessary can be embedded in a common insulation, around which shielding foil is then attached. Usually, however, the cores form a composite around which the shielding foil is conducted directly. Examples of these are the so-called shielded pairs, i.e., wherein a particularly pair-twisted wire pair is immediately surrounded by a shielding foil, as provided for example in high-speed data cables. Even with other structures, such as a star-quad structure, the special design of the shielding foil described herein can be used. Overall, a data cable may also be constructed from a plurality of the coaxial cables described herein.

Preferably, however, the design of the data line is provided as a coaxial cable.

Such a data line is suitably inserted within a motor vehicle electrical system.

Further scope of applicability of the present invention will become apparent from the detailed description given hereinafter. However, it should be understood that the detailed description and specific examples, while indicating preferred embodiments of the invention, are given by way of illustration only, since various changes, combinations and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
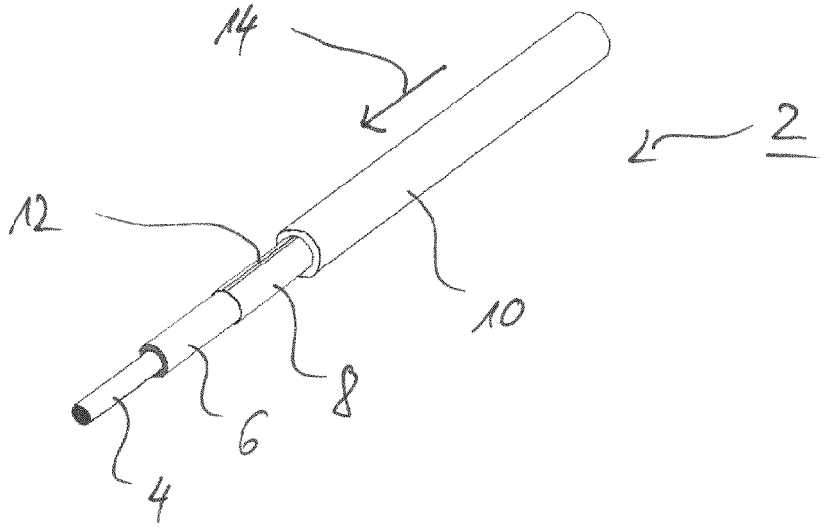
FIG. 1 is a perspective view of a coaxial cable as a data line, each with partially exposed components for clarity.

The data line 2 shown in FIG. 1 is exemplified in the preferred embodiment of a coaxial cable. The data line 2 in this case comprises a central inner conductor 4, which is surrounded by an insulation 6 immediately and concentrically. The insulation 6 forms a dielectric. On the insulation 6, in turn a shielding foil 8 is directly and concentrically mounted, representing an outer conductor. The shielding foil is then in turn surrounded directly and concentrically by an outer shell 10.

The shielding foil 8 is a longitudinally folded shielding foil 8, which is usually applied in the manufacturing process lengthwise, immediately prior to an extrusion of the outer shell 10. The shielding foil 8 thus forms an overlap region 12, which is oriented parallel to a longitudinal direction 14 of the data line 2.

Figure 2:
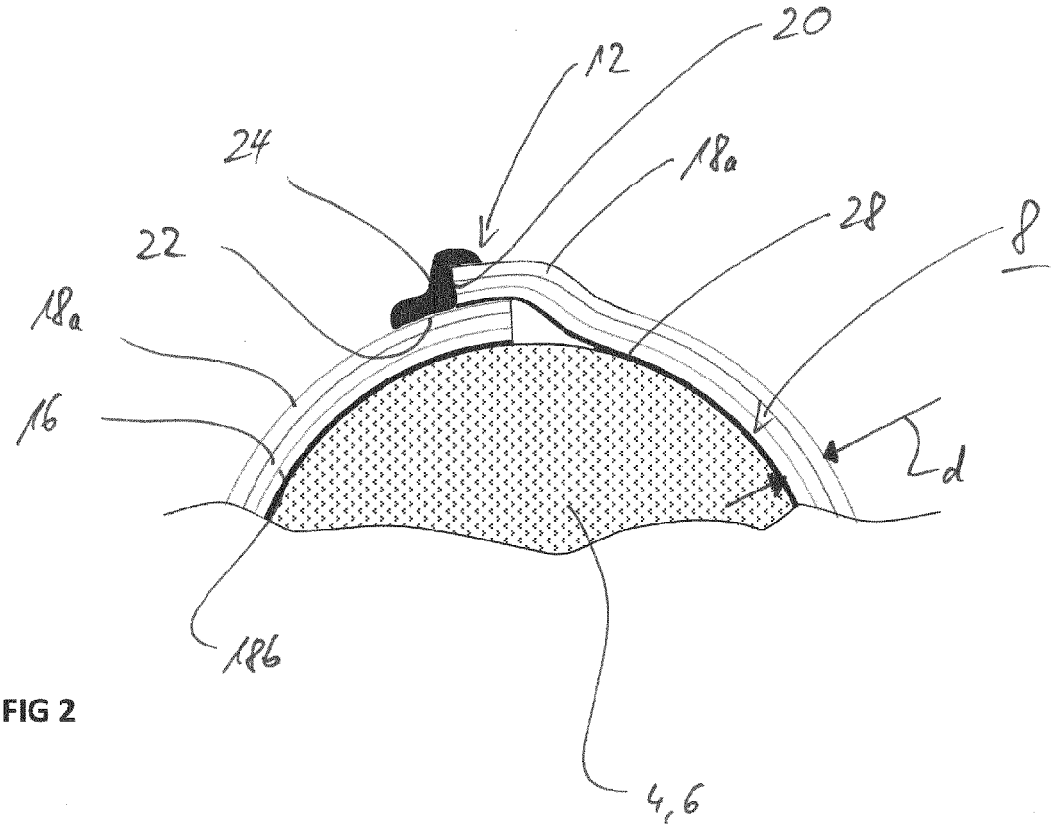
FIG. 2 is a partial cross-sectional view of a shielding foil with a line core in an overlap region with a conductive strip to form a conductive bridge between an end edge and a flat partial region of the shielding foil.
Figure 3:
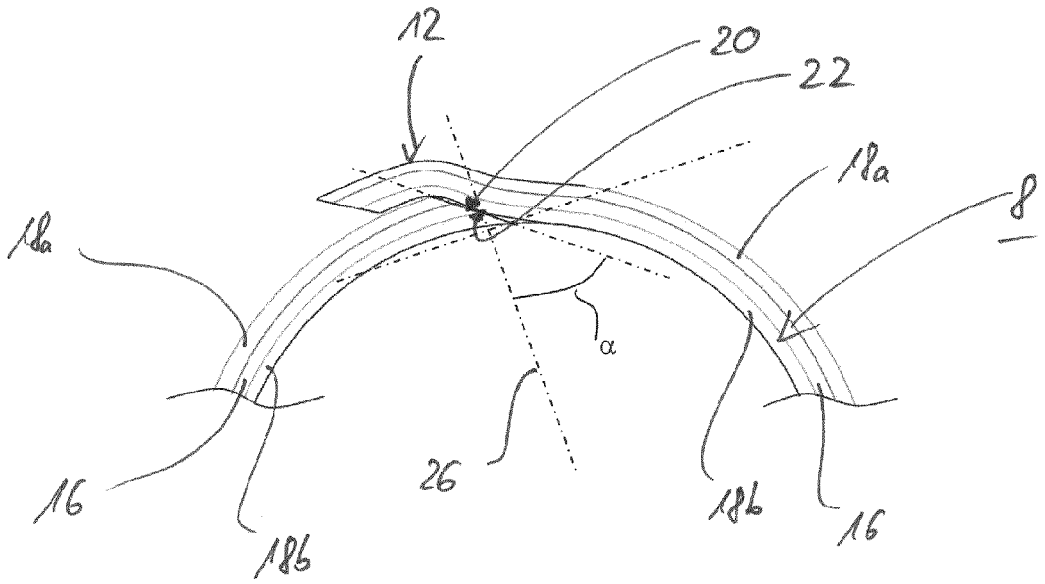
FIG. 3 is a partial cross-sectional view of a shielding foil in the overlap region according to a second embodiment with a beveled end edge.

As shown particularly in FIGS. 2 and 3, the shielding foil 8 is a multi-layered shielding foil 8, in the embodiment, a three-layer shielding foil 8. Said shielding foil has as a carrier layer a nonconductive layer 16 and attached to both sides thereto, conductive layers 18*a*, 18*b*. Reference numeral 18*a* thereby designates the outwardly facing conductive layer and reference numeral 18*b* designates the inwardly facing conductive layer. The shielding foil 8 is in particular a laminated foil, wherein on the carrier layer 16 on both sides in particular metal layers for forming the conductive layers 18*a*, 18*b* are applied. The conductive layers 18*a*, 18*b* thereby extend over the total surface of the non-conductive layer 16. The shielding foil 8 has an overall thickness d, which is preferably <60. The two conductive layers 18*a*, 18*b* have, for example, a thickness ranging from 20 to 30 microns, and the remainder is attributed to the non-conductive layer 16 of the carrier layer.

As can be seen in FIGS. 2 and 3, two longitudinal edge portions of the shielding foil 8 overlap in the overlap region 12, without either of the longitudinal edges of the shielding foil 8 being folded in that region. In the area of these longitudinal edges, the shielding foil 8 has in each case an end edge 20. In both embodiments, an electrically conductive connection of one of the two conductive layers 18*a*, 18*b* at the end edge 20 is thus formed with a flat, further partial region 22 of the same layer 18*a*, 18*b* in the overlap region 12.

In the embodiment of FIG. 2, this is done by means of a conductive strip 24, which is attached to the end edge 20 and so to speak, surrounds the end edge 20 in the longitudinal direction 4 with conductive material. In this way, an electrically conductive connection and thus a conductive bridge is formed between the outer conductive layer 18*a* on the end edge 20 and the same conductive layer 18*a* in the further partial region 22. Therefore, the outer layer 18*a* is electrically closed, so that even in the circumferential direction, transverse currents can flow within the layer 18*a*.

In the embodiment of FIG. 3, the end edge 20, in particular the end edge of the longitudinal edge of the shielding foil 8 lying below, is beveled in shape, so that a preferably acute angle $\alpha$ is formed. The end edge 20 is oriented at an angle $\alpha$ with respect to a surface normal 26, which is preferably >45° and in particular >60°. By means of this measure, a region projecting beyond the central non-conductive layer 16 is formed on the lower conductive layer 18*b*, via which the electrically conductive connection subsequently takes place at the end edge 20 with the same lower layer 18*b* in the further partial region 22. In this further region 22, the shielding foil 8 thus conforms with its lower conductive layer 18*b* to the beveled end edge 20.

In principle, the embodiments of FIGS. 2 and 3 can also be combined with one another, i.e., in addition to the conductive strip 24, the beveled end edge 20 is formed.

In order to ensure a reliable, flat, permanently firm adhesion of the shielding foil 8 at the insulation 6, an adhesive layer 28 is furthermore formed which is disposed between the insulation 6 and the innermost layer 18*b* of the shielding foil 8. This is exemplarily illustrated in FIG. 2. The adhesive layer 28 is, for example, a hot-melt adhesive layer, which is applied on the lower conductive layer 18*b* of the shielding foil 8 immediately before attaching said foil. In addition to the connection with the isolation 6, an advantage is that the two longitudinal edges of the shielding foil 8 are fixed to each other in the overlap region 12 by means of the adhesive layer 28.

Also, immediately subsequent to the attachment of the shielding foil 8, the outer shell 10 is applied by an extrusion method. For this purpose, a so-called shell extruder is used. Immediately in advance of the shell extrusion, the shielding foil 8 is supplied lengthwise to the shell extruder. At the same time, an application device, for example, a nozzle, etc. for the outer shell 10 is arranged in front of the extrusion head, by means of which the conductive strip 24 is applied in the region of the end edge 20.

Through the heat introduced during the extrusion of the outer shell 10, the hot melt adhesive of the adhesive layer 28 is activated and the adhesive bond between the insulation 6 and the shielding foil 8 is formed.

The beveled end edge 20 in the embodiment of FIG. 3 is preferably formed by means of a cutting operation. For this, a conventionally prepared shielding foil 8 is designed, for example, with the help of an inclined blade. Alternatively, a conventionally primed shielding foil 8 is beveled with perpendicular edges at the cut edges, for example by scraping.

Figure 4:
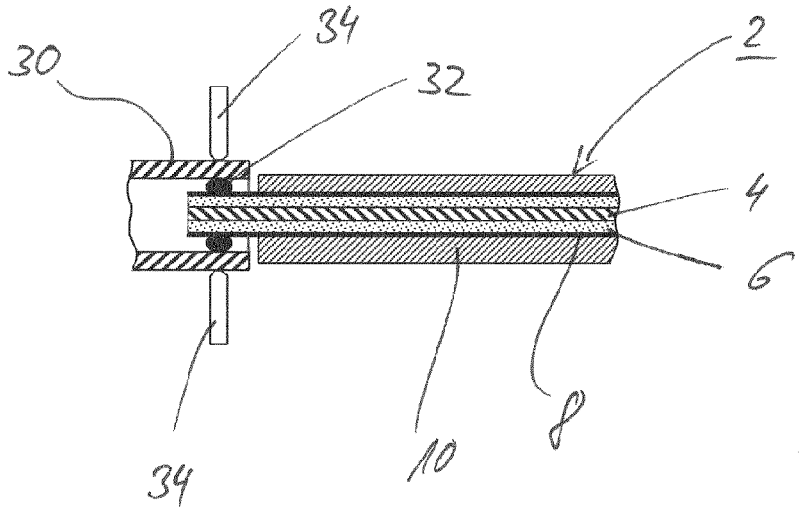
FIG. 4 is a simplified cross-sectional view in the end region of a data line with a contact element.

The contacting of the shielding foil 8 with a contact element 30 is exemplified in FIG. 4. The contact element 30 is preferably formed as a ring-shaped or cylindrical contact sleeve. The data line 2 is loaded with one end face freed from the outer shell 10 into the contact element 30.

An annular strip of a solder paste 32 is attached on the shielding foil 8. The electric contact connection with the contact element 30 takes place via the solder paste 32. For this purpose, no pressing force is necessary. The contact connection is thus free of pressure and is cohesive.

To form the electrical contact connection, in the manufacture thereof, an electric current in the area of the solder paste 32 is conveniently supplied by means of two electrodes 34, so that a short-term and local overheating occurs, so that the solder paste 32 is melted and the desired, permanently electrically conductive connection is formed. As an alternative to the solder paste 32, a conductive adhesive may be used.

As an alternative to a contact sleeve, the contact element 30 is a crimp area of a conventional plug-in contact element. Such a crimping area usually forms a cage for receiving the line to be contacted. This is usually formed by crimping lugs, which project and are bent in a normal crimping process. When using such a conventional plug-in contact element with a crimp area, which are usually designed as bent sheet metal stamped parts, when using the present data line 2, crimping is omitted and only the integral connection described in regards to FIG. 4 is formed. The contact element 30 is generally a part of a plug-in contact.

The data line 2 described herein is used in particular in a motor vehicle electrical system. With the measures described here, a particularly cost-effective manufacture is achieved with good shielding effect.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A data line comprising:

a line core extending in a longitudinal direction, the line core formed of at least one conductor and an insulation, the at least one conductor surrounded by the insulation; and a shielding foil that surrounds the insulation, wherein the shielding foil is formed of a non-conductive layer with a first conductive layer attached to an outer side of the non-conductive layer and a second conductive layer attached to an inner side of the non-conductive layer, the outer side of the non-conductive layer opposing the inner side of the non-conductive layer, wherein the shielding foil surrounds the insulation such that a first free end edge of the shielding foil overlaps a second free end edge of the shielding foil in an overlap region, wherein a region of the shielding foil directly adjacent the overlap region is an additional partial region, wherein a distal end face of a first free end edge of the first and second conductive layers is electrically conductively connected to an outer side of the first conductive layer provided in the additional partial region by an electrically conductive connection, the distal end face of the first conductive layer extending between the outer side and an inner side of the first conductive layer and the distal end face of the second conductive layer extending between an outer side and an inner side of the second conductive layer, wherein the electrically conductive connection is an additional conductive strip attached to the shielding foil so that the additional conductive strip is directly attached to the distal end face of the first and second conductive layers and to the additional partial region, so as to electrically connect the distal end face of the first and second conductive layers with the additional partial region, and wherein the additional conductive strip extends over and is directly attached to a portion of the outer side of the first conductive layer at the first free end edge, such that the additional conductive strip is substantially s-shaped in cross-section.

2. The data line according to claim 1, wherein the additional conductive strip is formed by applying a conductive material via an application method including spraying, printing, painting, or gluing.

3. The data line according to claim 1, wherein the shielding foil is formed as a longitudinally-folded foil, in which the first and second free end edges of the shielding foil run parallel to the longitudinal direction.

4. The data line according to claim 1, wherein the first and second conductive layers of the shielding foil each have a thickness in a range of 3 microns to 35 microns.

5. The data line according to claim 1, wherein the shielding foil is surface-bonded with the insulation by an adhesive layer or a hot adhesive layer, such that the adhesive layer or the hot adhesive layer is positioned between the shielding foil and the insulation.

6. The data line according to claim 1, wherein the non-conductive layer, the first conductive layer and the second conductive layer of the shielding foil are full-surface mounted on each other, and wherein despite the non-conductive layer, a completely circumferential connection is formed within the first and second conductive layers.

7. The data line according to claim 1, wherein the shielding foil, at first and second distal ends, is cohesively and electrically conductively connected with a contact element by gluing, soldering or welding.

8. The data line according to claim 1, wherein the insulation is made of a heat-resistant material that withstands a temperature of over 100° C. or over 150° C.

9. The data line according to claim 1, wherein the insulation comprises a cross-linked plastic.

10. The data line according to claim 1, wherein the data line is a coaxial cable and the shielding foil is a single shield element that forms an outer conductor, which is surrounded by an outer shell.

11. The data line according to claim 1, wherein the shielding foil is a single shield element such that no additional shielding elements are provided in the data line.

12. A data line comprising:

a line core extending in a longitudinal direction, the line core formed of at least one conductor and an insulation, the at least one conductor surrounded by the insulation; and a shielding foil that surrounds the insulation, wherein the shielding foil is formed of a non-conductive layer with a first conductive layer attached to an outer side of the non-conductive layer and a second conductive layer attached to an inner side of the non-conductive layer, the outer side of the non-conductive layer opposing the inner side of the non-conductive layer, wherein the shielding foil surrounds the insulation such that a first free end edge of the shielding foil overlaps a second free end edge of the shielding foil in an overlap region, wherein a region of the shielding foil directly adjacent the overlap region is an additional partial region, and wherein a distal end face of a first free end edge of the first and second conductive layers is electrically conductively connected to an inner side of the second conductive layer provided in the additional partial region, the distal end face of the first conductive layer extending between an outer side and an inner side of the first conductive layer and the distal end face of the second conductive layer extending between an outer side and the inner side of the second conductive layer, wherein the distal end face of the first and second conductive layers is beveled, and wherein, at the beveled distal end face of the first and second conductive layers, a contact to the additional partial region is formed, such that the beveled distal end face of the first and second conductive layers is directly attached to the inner side of the second conductive layer in the additional partial region.

13. The data line according to claim 12, wherein the angle with respect to a surface normal of the shielding foil is greater than 30°.

* * * * *